United States Patent [19]

de Cadier

[11] 4,283,058

[45] Aug. 11, 1981

[54] SEQUENCE ARRANGING BOARD GAME

[75] Inventor: Marie de Cadier, Pirbright, England

[73] Assignee: Eugene A. A. E. de Cadier, Pirbright, England; a part interest

[21] Appl. No.: 28,870

[22] Filed: Apr. 10, 1979

[30] Foreign Application Priority Data

Apr. 12, 1978 [GB] United Kingdom ..... 14317/78

[51] Int. Cl.[3] ..... A63F 3/00

[52] U.S. Cl. ..... 273/236; 273/272

[58] Field of Search ..... 273/236, 242, 243, 248, 273/249, 250, 251, 252, 253, 254, 258; 35/31 F; 273/271, 272, 273, 287

[56] References Cited

U.S. PATENT DOCUMENTS

| | | | |
|---|---|---|---|
| 438,757 | 10/1890 | Bliss | 35/31 F |
| 1,633,445 | 6/1927 | Gail et al. | 273/272 |
| 2,484,026 | 10/1949 | Gutridge | 273/236 |
| 2,791,430 | 5/1957 | King | 273/236 |
| 2,811,360 | 11/1960 | Cohen | 273/272 |
| 3,460,835 | 8/1969 | Crans | 273/236 |
| 4,126,315 | 11/1978 | Tung | 273/271 |

FOREIGN PATENT DOCUMENTS

| | | | |
|---|---|---|---|
| 2068299 | 8/1971 | France | 273/272 |
| 465979 | 6/1937 | United Kingdom | 273/272 |
| 1220371 | 1/1971 | United Kingdom | 273/272 |
| 1304882 | 1/1973 | United Kingdom | 273/272 |
| 1309899 | 3/1973 | United Kingdom | 273/272 |
| 1396267 | 6/1975 | United Kingdom | 273/272 |

*Primary Examiner*—Richard C. Pinkham
*Assistant Examiner*—Scott L. Brown
*Attorney, Agent, or Firm*—Sandler & Greenblum

[57] ABSTRACT

Apparatus for playing a board game, the apparatus comprising a board (2) with a playing surface marked with a first array of parallel rows (3) of playing positions (1), and a second array of parallel rows (4) of playing positions (1) extending transversely to the first array of rows (3) and with common playing positions where the rows of the two arrays cross over one another. At least some of the rows (3, 4) are sub-divided by barriers (7) into sections (3, 4) of playing positions (1). Four distinguishable sets of playing pieces are provided, each playing piece having one of a number of different indicia thereon. The indicia are arranged to form a predetermined sequence, the playing pieces of each set having the same group of indicia and at least a majority of the indicia being duplicated in each set.

9 Claims, 1 Drawing Figure

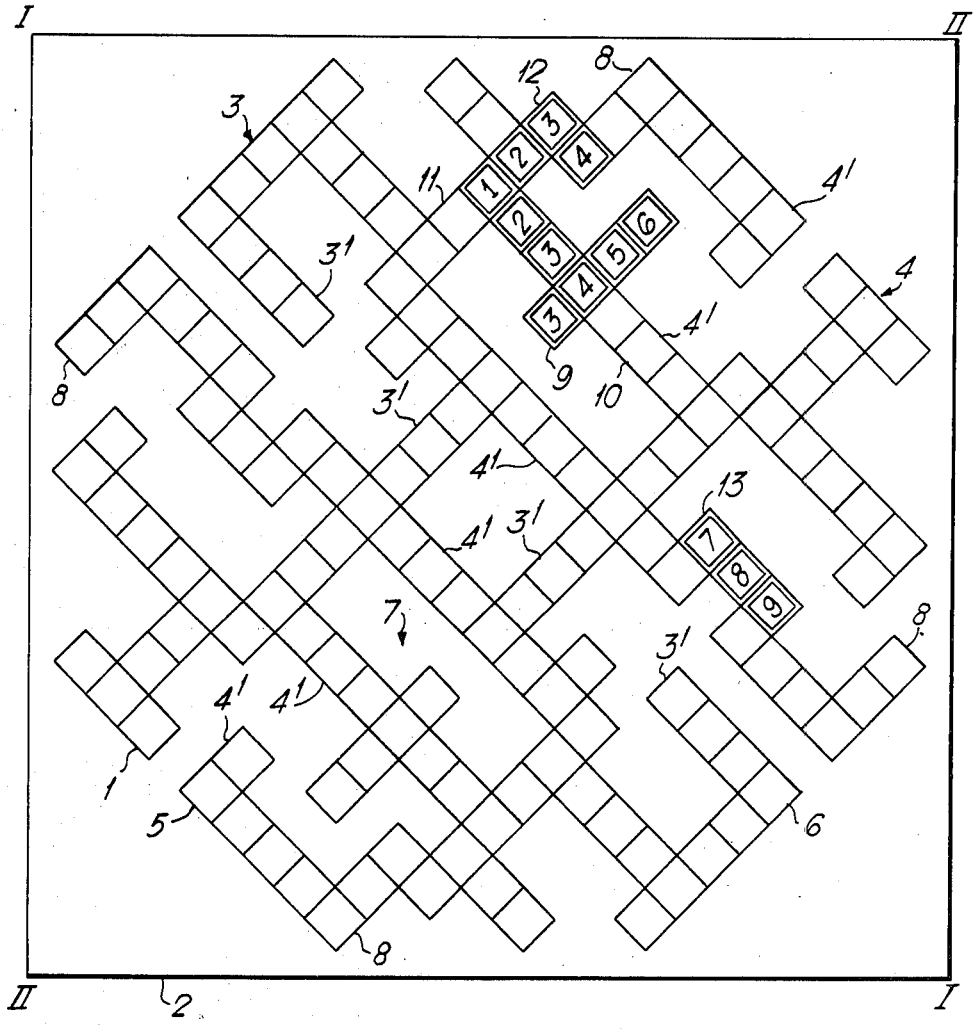
I
II
3
12
8
11
1
2
3
4
2
3
5
6
3
4
4'
4
3'
4'
9
10
8
3'
4'
13
7
8
9
4'
3'
7
8
3'
4'
4'
1
5
6
8
II
2
I

SEQUENCE ARRANGING BOARD GAME

The invention relates to board games and in accordance with the present invention apparatus for playing a board game comprises a board with a playing surface marked with a first array of parallel rows of playing positions, a second array of parallel rows of playing positions extending transversely to the first array of rows and with common playing positions where the rows of the two arrays cross over one another, and at least some of the rows being sub-divided by barriers into sections of playing positions; and four distinguishable sets of playing pieces, each playing piece having one of a number of different indicia thereon, the indicia being arranged to form a predetermined sequence, the playing pieces of each set having the same group of indicia and at least the majority of the indicia being duplicated in each set.

Preferably, the indicia are numerals and, in this case, the numerals may form the sequence one to ten.

In another example, the indicia may be letters of the alphabet, in which case they may form the sequence A to Z. Each letter may be given a value, for example from A=1 to Z=26.

The board preferably has a square playing surface with the rows of each array extending across the surface parallel to a respective diagonal. A typical board may have arrays, the rows of which extend transversely to each other and which successively reduce in length from a central row extending diagonally of the playing surface to short rows extending across the corners of the playing surface. Each central row may have nineteen playing positions, while the outermost rows may have nine playing positions. Each row may be divided into sections of between one and ten playing positions by barriers formed by unmarked areas on the playing surface. Preferably, each playing position has a square boundary.

The playing pieces may be tablets of for example square shape and each set may include thirty pieces divided into three groups of ten with the pieces of each group bearing respectively the numerals 1 to 10. Each set will thus include three playing pieces bearing the numeral 1, three bearing the numeral 2, and so on up to 10. The playing pieces of each set may be distinguished by being differently coloured or by having some other distinguishable characteristic.

The game may be played by two or four players. With two players, each player uses the playing pieces of a different two of the sets and each may have a maximum of ten pieces in his hand at any time. With four players, each player has his own individual set of playing pieces and may only have a maximum of eight pieces in his hand.

Initially the game is played by each player taking an equal number of playing pieces from a store of his own sets or sets of playing pieces in which the indicia are hidden, for example from a bag of the playing pieces or from a store in which the playing pieces are turned face downwards. These may then be laid on the table face upwards. Each player in turn places one or more playing pieces side by side on a section of playing positions so that the indicia of the playing pieces placed are in sequence with one another. He then replenishes his hand by taking from his store a number of further playing pieces equal to the number which he has placed on the board. Rules may determine how the first player is restricted in playing his pieces.

Subsequent players may place one or more playing pieces end to end with pieces already played, provided that the original sequence of indicia is continued, or on a row extending transversely to that on which playing pieces have been played provided that a playing piece is or will be placed on the position where the two rows meet or cross over one another and provided that the indicia on the playing pieces meeting at the position common to both rows are in separate sequences continuous with the indicium on the piece at that position. As an alternative, instead of adding onto playing pieces already played, a player may place his pieces separately from those already played, provided that two or more pieces are played, their indicia are in sequence with one another, and that they completely fill a row section. Thereafter a player may add on to any pieces already on the board or fill a new row section, hitherto unused.

If a player finds that he cannot form or add to a sequence, he may exchange one of his playing pieces for one in his store and then try to form or continue a sequence if he can.

The game continues until one player has used all his pieces and is declared the winner, or until no more pieces can be played. In the latter case, when the indicia are numerals, or letters to which values have been assigned, the winner is the one in respect of which the numerals on, or the playing values of, the playing pieces left in his hand add up to the smallest total; whereas in all other cases the winner is the player with the least number of playing pieces left in his hand.

An example of apparatus in accordance with the present invention will now be described with reference to the accompanying diagrammatic drawing.

The playing positions 1 are provided on the square board 2 and are arranged in two arrays of rows, rows 3 of one array extending parallel to a diagonal I—I and rows 4 of the other array extending parallel to a diagonal II—II.

Central rows 5,6 of respective arrays extend along the corresponding diagonals and are divided up by barriers formed by unmarked areas 7 into a number of sections 4', 3' of playing positions 1. In this example, the central row 5 is divided up by spaces 7 into two sections 4' each with two playing positions 1 and four sections 4' each with one playing position 1. The central row 6 is divided up by spaces 7 into two sections 3' each with four playing positions 1 and two sections 3' each with one playing position 1.

The other rows of each array are divided up in a similar way by spaces 7 into a number of sections 3', 4' with (at most) ten playing positions 1. For example, the outermost rows 8 each have one section with three playing positions 1 and one section with five playing positions 1. There are more sections having only one playing position than any other; the next predominant number of sections is those having two playing positions 1.

An example, of a game involving four players will now be described. Each player is provided with a set of thirty tablets divided into three groups of ten with the tablets of each group bearing the numerals 1 to 10. Each player first draws eight tablets from his stock. The game then commences by the first player selecting tablets from his hand with which he can completely fill a section of a row having two or more playing positions; for example, by placing tablets with the numbers 3 to 6 in a row section 9 of four playing positions which is transverse to a row 10 of eight playing positions. He then replenishes his hand by taking four further tablets from his stock. The next player can then fill completely a separate row section with two or more playing positions 1 or add to a tablet already placed on a playing position 1 common to two row sections. In this example, the second player has placed tablets with the numerals 2 and 3 in the row section 10, the tablet with numeral 3 being placed adjacent to the previously placed tablet with numeral 4. He also replenishes his hand by taking two tablets from his stock.

The third player, who already has tablets with the numerals 1,2 and 3 places these in a row section 11 (as shown) with the tablet with the numeral 1 completing the partially formed sequence in the row section 10 and starting the sequence in the row section 11. He replenishes his hand by taking three tablets from his stock. The fourth player, who finds he cannot play, exchanges one of his tablets with one in his stock. He withdraws a tablet with the numeral 4 and places this tablet adjacent to the tablet with numeral 3 in a row section 12. He then draws a further tablet from his stock to replace the one played.

Play then passes back to the first player who can either continue a partially formed sequence, for example by adding tablets with numerals 5 and 6, or 3 and 2 to the last played tablet, or by forming a new sequence which completely fills an unused row section with two or more playing positions 1, for example by placing tablets with the numerals 7,8 and 9 in a row section 13 (as shown).

As play continues, each player attempts, by skillful play, to place as many of his tablets as possible during one turn. Play ends when one of the players has placed all his tablets on the board, in which case he wins the game, or when no further tablets can be placed. In the latter case, the winner is the player whose tablets total the lowest number of points. If the points are the same all round, the game is declared a draw.

I claim:

1. Apparatus for playing a board game, said apparatus comprising a board, said board having a playing surface, said playing surface defining a first array of parallel rows of playing positions and a second array of parallel rows of playing positions extending transversely to said first array of rows, said arrays defining common playing positions where said rows of the two arrays cross over one another; a plurality of barriers sub-dividing at least some of said rows into sections of playing positions, wherein the number of said sections having two playing positions is equal to or greater than the number of any other sections which have the same number of playing positions as each other, said same number being at least three; and four distinguishable sets of playing pieces, each playing piece having only one of a number of different indicia thereon, said indicia being arranged to form a predetermined sequence, the playing pieces of said sets having at least a majority of the indicia of said predetermined sequence, the indicia on the playing pieces in each set being the same.

2. Apparatus according to claim 1, wherein said indicia comprise numerals.

3. Apparatus according to claim 2, wherein said numerals form the sequence 1 to 10.

4. Apparatus according to claim 1, wherein said indicia comprise letters of the alphabet.

5. Apparatus according to claim 1, wherein each of said playing pieces comprises a square tablet.

6. Apparatus according to claim 1, wherein said sets of playing pieces are distinguished by being differently coloured.

7. Apparatus according to claim 1, wherein said playing surface is square, said rows of each array extending across said surface parallel to respective diagonals.

8. Apparatus for playing a board game, said apparatus comprising:

(a) a board having a generally square playing surface, said playing surface having a first array of parallel rows of playing positions, each row of said first array being parallel to one diagonal of said surface, a second array of said parallel rows of playing positins extending transversely to said first array, each row of said second array being parallel to a diagonal of said surface transverse to said one diagonal, said arrays crossing over each other to define a plurality of common playing positions, and a plurality of barriers dividing at least some of said rows into sections of playing positions, wherein the number of said sections having two playing positions is equal to or greater than the number of any other sections which have the same number of playing positions as each other, said same number being at least three; and (b) at least two distinguishable sets of playing pieces, each of said playing pieces having indicia thereon, each of said sets comprising at least two groups of playing pieces, said playing pieces in each group having indicia which form part of a predetermined sequence, the pieces of each of said sets having at least a majority of the indicia of said predetermined sequence thereon, the indicia on the playing pieces of each set being the same.

9. Apparatus in accordance with either of claims 1 or 8, wherein the number of sections having two playing positions is greater than the number of sections having three playing positions, the number of sections having three playing positions is greater than the number of sections having four playing positions, the number of sections having four playing positions is greater than the number of sections having five playing positions, the number of sections having five playing positions is greater than the number of sections having six playing positions, and the number of sections having six playing positions is greater than the number of sections having seven playing positions.

* * * * *